United States Patent [19]

Evans

[11] 3,997,233

[45] Dec. 14, 1976

[54] FLAT CONDUCTOR CABLE CONNECTOR

[75] Inventor: Robert Franklin Evans, New Cumberland, Pa.

[73] Assignee: E. I. Du Pont de Nemours and Company, Wilmington, Del.

[22] Filed: Feb. 19, 1976

[21] Appl. No.: 659,247

[52] U.S. Cl. ..... 339/97 C; 339/98

[51] Int. Cl.[2] ..... H01R 11/20

[58] Field of Search ..... 339/97 C, 98, 99

[56] References Cited

UNITED STATES PATENTS

| | | | |
|---|---|---|---|
| 3,395,381 | 7/1968 | Huffnagle | 339/97 C |
| 3,553,347 | 1/1971 | Bushey et al. | 339/97 C X |
| 3,703,604 | 11/1972 | Henschen et al. | 339/97 C X |
| 3,715,705 | 2/1973 | Kuo | 339/98 |
| 3,728,473 | 4/1973 | Kuo | 339/97 C X |
| 3,851,945 | 12/1974 | Collier | 339/97 C |
| 3,880,488 | 4/1975 | Collier et al. | 339/97 C |

FOREIGN PATENTS OR APPLICATIONS

| | | | |
|---|---|---|---|
| 1,211,002 | 11/1970 | United Kingdom | 339/97 C |

OTHER PUBLICATIONS

Publication: "Now: Mass–terminate flat conductor cable quickly, reliably to mate with posts & pr boards", 8/74.

*Primary Examiner*—J. Howard Flint, Jr.

[57] ABSTRACT

A flat conductor cable connector includes a base for receiving a conductor including a pair of apertures in the base and a pair of upstanding insulation-rupturing lances spaced inwardly of the apertures in the base, and an arm hingedly connected with the base including a pair of lances, each lance in alignment with one of the apertures in the first layer of the base.

7 Claims, 4 Drawing Figures

FLAT CONDUCTOR CABLE CONNECTOR

BACKGROUND OF THE INVENTION

1. Field of the Invention:

The present invention relates to a crimpable connector for a flat conductor cable.

2. Description of the Prior Art:

An electrical connector for a flat conductor cable including a base and a platform spaced from but overlying the base is described in U.S. Pat. No. 3,880,488. The platform has a pair of lances so that on crimping the connecting portion to a flat flexible cable, each lance pierces the conductor and engages a flat conductor in the cable. In this connector, the lances pierce an insulating sheath and a flat conductor encased in the sheath transverse to the plane of the cable supported on the base. Since the lances pierce the insulating sheath and conductor transverse to the plane of the cable, the insulating sheath is not stripped from the conductor and the lances contacting the conductor are not wiped along the surface of the conductor.

Another connecting device for a flat conductor cable is described in U.S. Pat. No. 3,395,381. In this device, a U-shaped channel includes a web having a pair of lances struck inwardly from a plane of the web. A segment of the web between the lances is coined to prevent the lances from moving back into the plane of the web when the U-shaped walls of the device are crimped and curled to pinch the conductor in engagement with the lances. Although this type of connection provides for stripping the insulation and wiping the lance along a surface of a flat conductor, it provides a pressure contact only at the points of intersection of the edges of the lances and the curled ends of the U-shaped walls.

The connector of the present invention provides a solution to all of the above problems by providing a substantially greater contact surface including two wiped contact points with the flat conductor between each lance on the base and the arm when the arm is crimped to clench the lances with the flat conductor. Additionally, contact pressure is provided over the transverse width of each lance resulting in substantially less initial contact resistance and lower contact resistance when the connection is exposed to environmental conditions over an extended period of time.

SUMMARY OF THE INVENTION

According to the present invention, a flat conductor cable connector is provided comprising a base having a first layer including a pair of apertures in the layer and a pair of upstanding insulation rupturing lances spaced inwardly of the apertures in the layer, and an arm hingedly connected with the base including a pair of lances, each lance in alignment with one of the apertures in the first layer of the base. Preferably, the base is of double thickness having a second layer co-extensive with the first layer including a window opening onto the apertures in the first layer for receiving a crimping anvil.

DESCRIPTION OF A PREFERRED EMBODIMENT

A preferred embodiment of a connector according to the present invention is described below with reference to the attached drawings wherein the same numerals are used throughout to identify the same elements.

Figure 1:
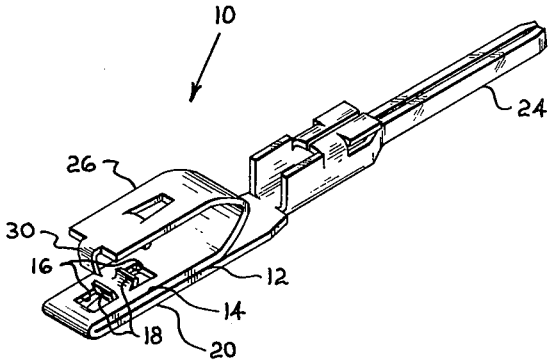
FIG. 1 is a perspective view of an embodiment of a connector according to the invention.
Figure 2:
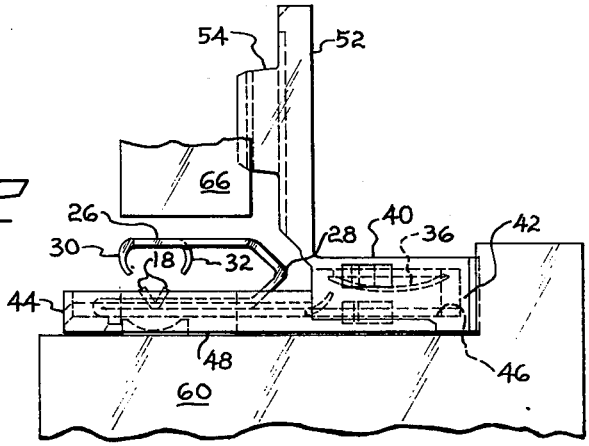
FIG. 2 is a side view of an embodiment of a connector according to the invention including an insulating housing and tooling for crimping a flat conductor cable in the connector.
Figure 3:
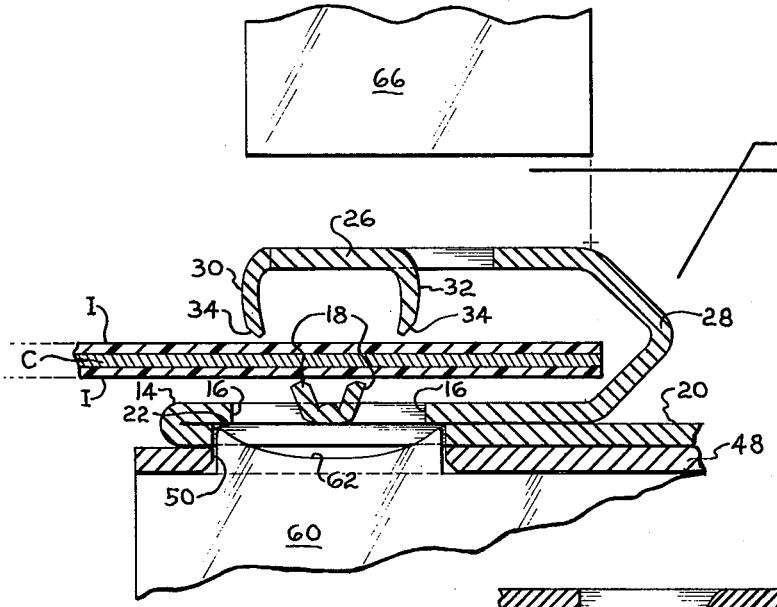
FIG. 3 is a fragmentary side view in section similar to FIG. 2.
Figure 4:
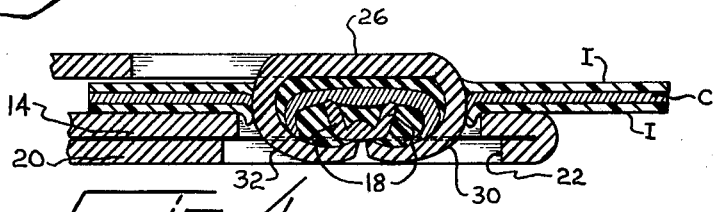
FIG. 4 is a side view in section similar to FIG. 3 illustrating the connector crimped to a flat conductor cable.

A flat conductor connector 10 according to the invention includes a double thickness base 12. A first layer 14 of the base 12 includes a pair of spaced apertures 16. A pair of upwardly projecting lances 18 are inclined at an obtuse angle with a segment of layer 12 between apertures 16. Each lance 18 has a width substantially equal to the width of each aperture 16. A second layer 20 of base 12 includes a window 22 opening onto the spaced apertures 16 in layer 14. A mating electrical contact, e.g. a male pin 24 as illustrated in FIG. 1 or a female contact as illustrated in phamton in FIG. 2, extends from layer 20 of base 12.

An arm 26 is hingedly connected to layer 14 of base 12 by a V-shaped hinge 28. A lance 30 is provided on the free end of arm 26 and a lance 32 is struck from a central portion of arm 26. Each lance 30, 32 is arcuately curved inwardly and includes a coined, work-hardened truncated sharp end 34. End 34 of each lance 30, 32 is in alignment with one of the apertures 16 in layer 14 of base 12.

An insulating housing 40 comprises a mating end 42 and a cable receiving end 44. The mating end 42 includes a cavity 46 for receiving a male or female terminal and a base 48 for receiving each connector 10. A cover 52 is hingedly connected to the housing 40 and includes a latch arm 54 at each side of the housing 40. A window 50 is provided in the base 48 of housing 40 for each connector 10.

The use of a connector according to the invention may be readily understood with reference to the drawings and the description below. A plurality of connectors 10 (one illustrated) are mounted in a housing 40. The housing 40 is mounted on lower tooling 60. The lower tooling 60 includes a dished anvil 62 which extends through window 50 in housing 40 and window 22 in layer 20 of base 12 of the connector 10. A flat conductor cable having an insulated sheath I and a plurality of flat conductors C (one illustrated) encased in the sheath I is inserted between the arm 26 and base 12 of the connector 10. Upper tooling 66 is moved downward to operatively engage arm 26, and the arm 26 is moved downward parallel to the base 12 of connector 10. Lances 30, 32 engage the insulated sheath I of the cable against lances 18 projecting upwardly from layer 14 of base 12. Sharp ends 34 of lances 30, 32 pierce the insulation I on one surface of the cable, the conductor C, and the insulation I on the other surface of the conductor C. Ends 34 of lances 30, 32 extend through the aligned apertures 16 and the window 22 in the base 12 and engage the dished anvil 62 of the lower tooling 60. Lances 18 rupture the insulation I on the lower surface of the cable. As the arm 26 engages the opposite surface of the cable, the lances 18 are spread and wiped along the surface of the conductor C. Lances 30, 32 are curled inwardly by anvil 62 and clench the conductor establishing a primary pressure, electrical contact between each lance 18 and the conductor C of the cable.

The inner surface of each lance 30, 32 piercing the conductor C establishes a secondary pressure electrical contact between each lance 30, 32 and the conductor C. The substantially equal width of lances 18 and 30, 32 provide for a pressure contact along the transverse width of the lances. The upper tooling 66 is withdrawn and the hinged cover 52 is closed and a latch arm 54 at each side of the housing 40 snaps over the base 48 of the housing 40. The connectors 10 in the housing provide for connecting the mating end of the housing and terminals mounted therein with a plurality of mating electrical connectors.

What is claimed is:

1. In a connector for a flat conductor cable comprising a base having a pair of spaced apertures therein, and an arm hingedly connected to the base including a pair of lances extending from the arm in alignment with the apertures in the base, the improvement comprising a pair of upwardly projecting inclined lances extending from said base, said lances in said base being spaced inwardly of said apertures in said base.

2. A connector, as recited in claim 1, wherein said lances extending from said base having a width substantially equal to the width of said apertures.

3. A connector as recited in claim 2, wherein each lance extends from a segment of said base between said apertures at an obtuse angle with said segment.

4. In a connector for a flat conductor cable comprising a double thickness base including a first layer and a second layer, the first layer having a plurality of spaced apertures therein and the second layer including an electrical contact extending therefrom, and an arm hingedly connected to the base including a pair of lances extending from the arm in alignment with the apertures in the base, the improvement comprising a pair of upwardly-projecting inclined lances extending from said base, said lances in said base being spaced inwardly of said apertures in said base, and a window in said second layer of said base opening onto said apertures in said first layer of said base.

5. A connector, as recited in claim 4, said contact being a male terminal.

6. A connector, as recited in claim 4, said contact being a female socket.

7. A connector, as recited in claim 4, additionally comprising an insulating housing, said housing including a mating end for receiving said contact and a cable-receiving end including a base having a window opening onto said window in the base of said connector and a cover engageable with said base hingedly connected to said housing.

* * * * *